US005829750A

United States Patent [19]

Booker

[11] Patent Number: 5,829,750

[45] Date of Patent: Nov. 3, 1998

[54] METHOD OF PLAYING A BLACK JACK WAGERING GAME

[76] Inventor: Lauren Booker, 6506 Camden Ave., San Jose, Calif. 95120

[21] Appl. No.: 696,567

[22] Filed: Aug. 16, 1996

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 4,861,041 | 8/1989 | Jones et al. | 273/292 |
| 5,154,429 | 10/1992 | Le Vasseur | 273/292 |
| 5,257,789 | 11/1993 | Le Vasseur | 273/309 |
| 5,257,810 | 11/1993 | Schorr et al. | 273/292 |
| 5,275,416 | 1/1994 | Schorr et al. | 273/292 |
| 5,288,077 | 2/1994 | Jones | 273/292 |
| 5,364,105 | 11/1994 | Jones | 273/292 |
| 5,407,208 | 4/1995 | Keller et al. | 273/274 |

OTHER PUBLICATIONS

Maverick Black Jack rules sheet submitted to copyright office for registration on May 2, 1995.
Brochure for "21 Superbucks".
Brochure for "Top O'The Black Jack".
"Over/Under 13 Blackjack", Gaming concepts Inc., 1988.

*Primary Examiner*—Benjamin H. Layno
*Attorney, Agent, or Firm*—Ian F. Burns

[57] ABSTRACT

A method of playing a card game of 21 or black jack which allows wagers on the occurrence of a black jack within certain categories of black jacks, the categories being defined by ranks and suits. A number of possible single hand and multi-hand categories of black jacks are defined. A player must place a wager on the occurrence of a black jack within one or more specified categories during the course of a standard game of black jack. If a specified hand or specified hands have a black jack which falls within the specified category, the player will win the wager according to a predetermined payout ratio. Bonuses may also be paid for certain categories.

18 Claims, 4 Drawing Sheets

70 -
A & J
1000 • 1
Spades
Both Ace & Jack
—$21,000—
Suited Black Jacks
A & J
1000 • 1
Spades
- 72
66 -
Suited
50 • 1
BJ
Both
—$2,100—
Suited Black Jacks
Suited
50 • 1
BJ
- 68
62 -
D
P
- 64
- 60

Dealer Black Jack
Player Black Jack
14 - 95
13 - 94
12 - 93
11 - 92
10 - 91
9 - 90
8 - 89
7 - 88
113 - 14
112 - 13
111 - 12
110 - 11
109 - 10
108 - 9
107 - 8
106 - 7
114
6 - 87
5 - 86
4 - 85
3 - 84
2 - 83
1 - 82
105 - 6
104 - 5
103 - 4
102 - 3
101 - 2
100 - 1
80

METHOD OF PLAYING A BLACK JACK WAGERING GAME

BACKGROUND OF THE INVENTION

1. Field of Invention

The present invention relates to a modified black jack wagering game which includes means for wagering on the occurrence of black jacks hands within particular categories of black jacks, the categories being defined by ranks and suits.

2. Description of Related Art

Blackjack or twenty-one wagering games are well known in the art and a number of variations have been developed. Some examples of modified black jack games can be found in U.S. Pat. No. 5,154,429 to LeVasseur, U.S. Pat. No. 5,257,810 to Schorr et al., U.S. Pat. No. 5,275,416 to Schorr et al., and U.S. Pat. No. 5,288,077 to Jones. However, the games disclosed in these references fail to provide a means for players to wager on the occurrence of particular categories of black jacks using ranks and suits to determine categories. Black jacks may be grouped into at least six different categories, each category representing a particular arrangement of cards. These categories may include the following:

1. standard black jacks;
2. rank black jacks;
3. suited black jacks;
4. certain suited black jacks;
5. suited rank black jacks; and
6. certain suited rank black jacks.

These categories may be used to categorize any player's and a dealer's hand.

A standard black jack is the broadest category and it is a combination of any ace and any card with the value of ten (ten value card). No particular rank or suit is required. Under standard rules, kings, queens, jacks, and tens of any suit have a value of ten. A rank black jack is an ace and a ten value card of a certain specified rank, both cards being of any suit. For example, a rank black jack may be any ace and any king, if king is the specified rank, or any ace and any queen, if queen is the specified rank. A suited black jack is an ace and any ten value card, both cards being of the same suit. The cards may be any of the four suits (ace, clubs, hearts, or diamonds) as long as both cards are the same suit. For example, a suited black jack may be an ace of spades and a jack of spades or an ace of hearts and a queen of hearts. A subgroup of suited black jacks is a certain suited black jack where both the cards must be a certain specified suit. For example, a certain suited black jack may be an ace of spades and a jack of spades, if spades is the specified suit, or an ace of hearts and a king of hearts, if hearts is the specified suit.

A suited rank black jack is an ace and a ten value card of a particular rank, both cards being of the same suit. The cards may be of any of the four suits as long as they are the same suit. For example, a suited rank black jack may be an ace of spades and a jack of spades, if jack is the specified rank, or an ace of hearts and a queen of hearts, if queen is the specified rank. A subgroup of suited rank black jacks is certain suited rank black jacks. A certain suited rank black jack is an ace and a ten value card of a certain specified rank where both cards are a certain specified suit. For example, a certain suited rank black jack may be an ace of clubs and a jack of clubs, if clubs is the specified suit and jack is the specified rank, or ace of diamonds and ten of diamonds, if diamonds is the specified suit and ten is the specified rank.

What the prior art does not suggest is the use of these different categories of black jacks as the basis upon which players may place wagers. Yet, the use of these categories to make wagers has many advantages. It has been found that if players are allowed to wager on the different categories of black jacks, players find the black jack game more interesting and enjoyable than the standard game. Because the expected frequency of occurrence (odds) of some of the categories is small, very large payouts and bonuses can be offered to players. This provides a much more intriguing game to most players than the standard black jack game. Using the additional wagers also increases income to casinos because the average percent hold is higher and more wagers are placed per deal. All this may be achieved by modifying existing black jack games and does not require casinos to remove existing games.

In addition to the single hand categories of black jacks discussed above, additional categories can be defined using two or more hands. These multi-hand categories may include the following:

1. standard black jacks;
2. same rank black jacks;
3. certain rank black jacks;
4. suited black jacks;
5. certain suited black jacks;
6. suited same rank black jacks;
7. suited certain rank black jacks; and
8. certain suit certain rank black jacks.

These categories may be applied to any player's hand and a dealer's hand. Some of these categories require the concurrent use of two or more decks of cards in the game depending upon the number of hands and the categories applied.

In the multi-hand categories, a black jack is the broadest category and it occurs when the applicable hands receive any black jack. The rank and suit are irrelevant. A same rank black jack occurs when the applicable hands receive a black jack of the same rank. The rank may be any rank as long as the rank is the same. A certain rank black jack occurs when the applicable hands receive a black jack of a certain specified rank. For example, the applicable hands receive an ace and ten, if ten is the specified rank, or an ace and a king, if king is the specified rank.

A multi-hand suited black jack occurs when the applicable hands receive suited black jacks. The suits may be any of the four suits and the applicable hands may have same suit. A multi-hand certain suited black jack occurs when the applicable hands receive a black jack of a certain specified suit. For example, the applicable hands receive an ace and ten value card of hearts, if hearts is the specified suit, or the applicable hands receive an ace and ten value card of clubs, if clubs is the specified suit.

A multi-hand suited same rank black jack occurs when the applicable hands receive suited black jacks of the same rank. The suits may be any of the possible suits and the rank may be any of the possible ranks as long as the rank is the same for both the player and the dealer. A multi-hand suited certain rank black jack occurs when the applicable hands receive suited black jacks and a certain specified rank. The applicable hands may be any of the possible suits or the same suit and the rank must be the specified rank. For example, the applicable hands may have an ace of diamonds and ten of diamonds, if ten is the specified rank, or the applicable hands may have an ace of spades and a jack of spades, if jack is the specified rank.

A multi-hand certain rank certain suit black jack occurs when the applicable hands receive a black jack of a certain specified rank and a certain specified suit. For example, the applicable hands receive an ace of clubs and a queen of clubs, clubs being the specified suit and queen being the specified rank, or the applicable hands receive an ace of hearts and a jack of hearts, hearts being the specified suit and jack being the specified rank.

The multi-hand categories may also be used as the basis for players to make additional wagers. Wagers on these categories offer the same advantages as wagers on the single hand categories discussed above. Because the multi-hand categories generally have even lower odds than single hand categories, even larger payouts and bonuses may be offered.

SUMMARY OF INVENTION

1. Objects of the Invention

It is another object of the invention to establish an order of black jack from high probability to low probability much like poker has a rank of hands starting from high card to a Royal Flush that sets a standard for higher ranked hands.

It is an object of the invention to provide a black jack game which includes means for wagering on the occurrence of certain categories of black jacks.

Another object of the invention is to allow players to wager on single hand and/or multi-hand categories of black jacks allowing more wagers to choose from.

It is a another object of the present invention to provide an improved black jack game which may be played in a casino or other location or on an electronic wagering machine.

It is another object of the present invention to provide an exciting and interesting black jack game which is easy to learn and is based on well known rules of standard black jack.

It is another object of the present invention to improve the entertainment value of the standard black game by changing the game from a flat paying one into other multi-level payouts and by doing so, to attract more players.

A further object of the invention is to provide a wagering game which is flexible and allows a house or casino to change the payout of the game to achieve various levels of income.

It is another object of the present invention to provide the highest possible payback to the player for wagering on a individual category of black jacks especially in a video format where a shuffle automatically occurs every hand.

Another object of the invention is to provide increased profit to casinos over prior art games by offering wagers which encourage players to bet more per hand.

2. Brief Description of the Invention

In accordance with the above objectives, the present invention provides a game which may be based on a table or in an electronic device, such as a video gaming machine. The game may be played in almost any setting but it is especially well adapted to casinos.

The game is based on the standard rules of black jack. In addition to a standard black jack wager, players may make at least one optional wager on the occurrence of a black jack within a specified category or categories of black jacks. Regions may be provided on a game table which indicate the categories available for a wager. A region may indicate an individual category or a combination of categories.

In the method of the game, each player may place a wager on at least one category of black jacks. The dealer then deals two cards to each player and two to himself. Each player and the dealer will then examine their own hand to determine if it contains a black jack. If a hand contains a black jack, it will be revealed. At this point the dealer can then resolve all category wagers according to a pay table.

The black jack categories for any particular game may include single hand or multi-hand categories. A single hand category may be applied to a player's hand or to the dealer's hand. If some multi-hand categories are used, it is necessary to use at least two decks of playing cards.

REFERENCE NUMERALS

Figure 1:
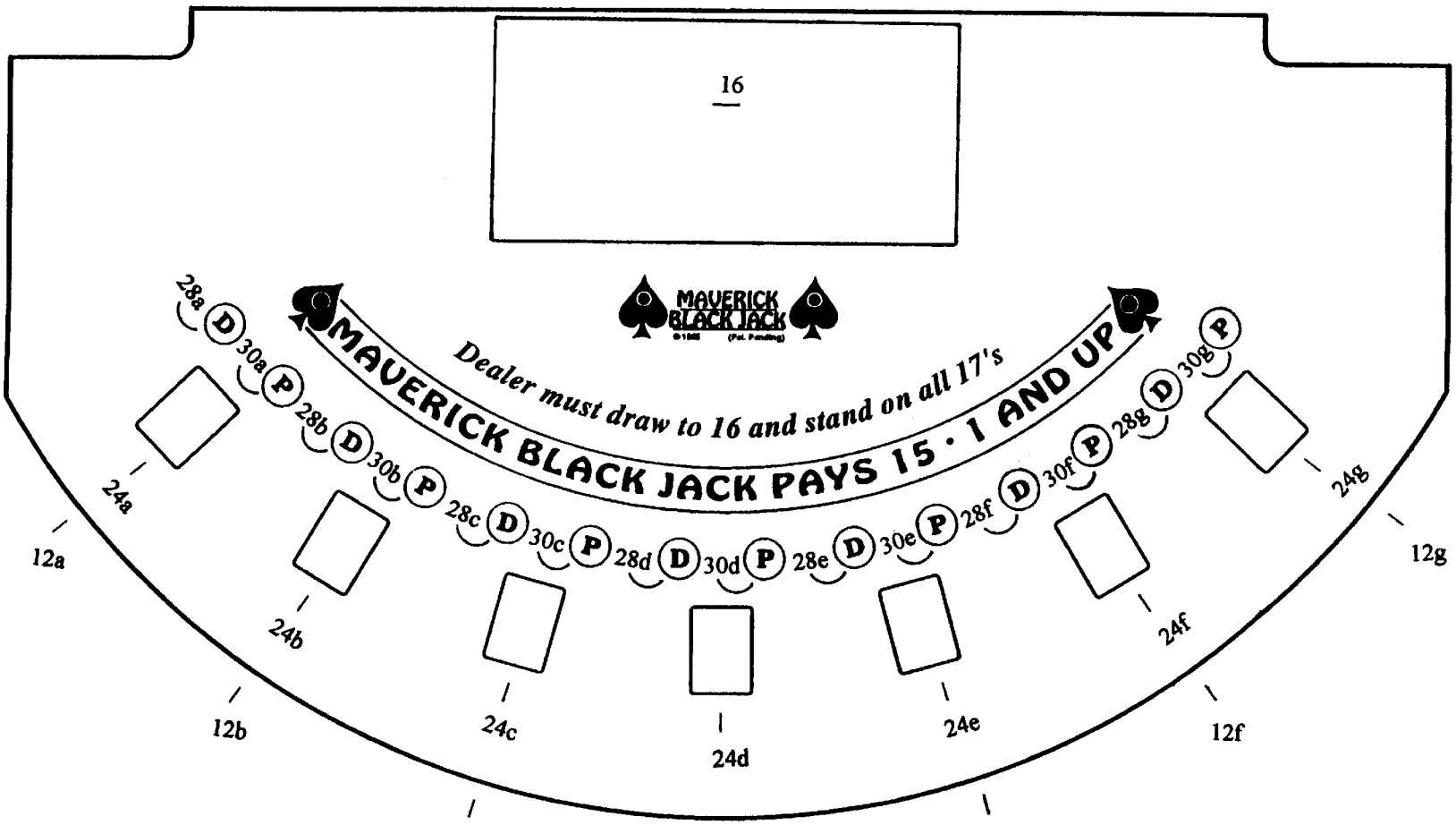
FIG. 1 is a top view of a table layout of one embodiment of the game of the invention.

10 gaming table
12*a–g* player position
14 dealer position
16 chip area
24*a–g* player card area
28*a–g* hand-wager position
30*a–g* hand-wager position
42 wager position
44 wager position
46 wager position
48 wager position
50 wager position
52 wager position
60 card region
62 dealer wager position
64 wager position
66 wager position
68 wager position
70 wager position
72 wager position
80 card region
82–95 dealer wager positions
100–113 player wager positions
114 line

DESCRIPTION OF THE PREFERRED EMBODIMENT

As seen in FIG. 1, a standard semicircular casino gaming table 10 may be used to implement the game of the present invention. Table 10 has a playing surface which indicates a number of regions for cards and wagers. The playing surface is preferably colorful felt but many other surfaces may be used. In the preferred embodiment, seven player positions 12*a–g* are indicated on the playing surface near the edge of table 10. The playing surface may be designed to accommodate any number of players. However, seven players are generally the maximum number which can be efficiently managed by a single dealer. A dealer position 14 is indicated on the flat edge of the table so that the dealer can face each of the players and observe their play. Dealers position 14 includes a chip area 16 which may be used to store chips, tokens, coins, or bills.

Each player position 12*a–g* is provided with player card areas 24*a–g*. These areas are for receiving player cards when the game is dealt and placing a standard wager. Each player position 12*a–g* may also be provided with dealer wager positions 28*a–g* and player wager position 30*a–g*. Dealer wager positions 28*a–g* are for wagering on the dealer's hand and player wager positions 30*a–g* are for wagering on the player's hand.

At the beginning of each game, each player may place wagers in the form of chips, tokens, coins, or bills in wager positions 28*a–g* and 30*a–g*. In the preferred embodiment, the wagers are in addition to a standard wager which may be placed on player card areas 24*a–g* or in another part of the table. The standard wager is be resolved according to the rules of standard black jack. Alternatively, no standard wager may be made and the wagers placed on wager positions 28*a–g* and 30*a–g* may be the only wagers made by the players.

Wager positions 28*a–g* and 30*a–g* can be defined to represent a single black jack category or a combination of black jack categories. As discussed above, there are single hand categories which may be applied to any player's hand or the dealer's hand, and there are multi-hand categories which may be applied to multiple players, multiple players and the dealer, or a player and the dealer. The single hand categories can include at least the following: standard black jacks, rank black jacks, suited black jacks, certain suited black jacks, suited rank black jacks, and certain suited rank black jacks. The multi-hand categories can include at least the following: black jacks, same rank black jacks, certain rank of black jacks, suited black jacks, certain suited black jacks, suited same rank black jacks, suited certain rank black jacks, and certain suit certain rank black jacks. By placing a wager on wager positions 28*a–g* and 30*a–g* a player wagers on the occurrence of at least one of these categories of black jacks, whatever the wager positions are defined to be. In this way, wager positions 28*a–g* and 30*a–g* are highly flexible and the casino operating the game may chose from the various categories of black jack to achieve different results.

In the preferred embodiment, if a player wagers on dealer wager position 28*a–g,* the player will be wagering on at least one single hand category which is applied to the dealer's hand. If a player wagers on player wager position 30*a–g,* the player will be wagering on two single hand categories which is applied to the player's hand. If a player wagers on both player and dealer wager positions 28*a–g* and 30*a–g,* the player will be wagering on at least one multi-hand category which is applied to the player's and dealer's hand. If one wager position is defined to be a single category, the wager placed on it is defined to be an individual wager. If one wager position is defined to be two or more categories, the wager placed on it is defined to be a combination wager.

After the players have placed their wagers, the dealer deals cards and all the hands are examined to see if they contain a black jack. If the player placed a wager on either wager position 28*a–g,* 30*a–g,* or both, the player's and/or dealer's hand will be examined to determine if the indicated category had occurred. If the indicated category had occurred, the player will be paid according to a pay table. For the embodiment disclosed in FIG. 1, the following pay table is one example of a pay table which may be used:

TABLE 1

| HAND | PAYOUT RATIO |
|---|---|
| Wager on One: Player's or Dealer's hand is: | |
| Black Jack | 15:1 |
| Suited Black Jack | 21:1 |
| Ace of Spades and Jack of Spades Black Jack | 100:1 |

By referring to this table, a player can see that wager positions 28*a–g* and 30*a–g* represent single hand categories and the player can determine what the occurrence of each category will payout. For example, if the player placed a wager on the player's hand (wager position 30*a–g*) and the player's hand was a suited black jack, the player would win 21 times the player's wager. If the player placed a wager on the dealer's hand (wager position 28*a–g*) and the dealer's hand was an ace of spades and jack of spades black jack (certain suited rank black jack), the player would win 100 times the player's wager. If the dealer's and/or player's hand does not fall within one of the categories defined by the pay table, the player will loose the player's respective wager. Bonuses may also be indicated on the pay table to indicate that a player would be paid a bonus if the player wagered on a category and a black jack in that category occurred.

The following table is another example of a pay table which may be used to define the categories and payout ratios:

TABLE 2

| HAND | PAYOUT RATIO |
|---|---|
| Wager on One: Player's or Dealer's hands is: | |
| 1. Black Jack | 15:1 |
| 2. Suited Black Jack | 21:1 |
| 3. Ace of Spades and Jack of Spades Black Jack | 100:1 |
| Must Wager on Both: Player's and Dealer's hands are: | |
| 4. Black Jacks | 30:1 |
| 5. Same Rank Black Jacks | 50:1 |
| 6. Suited Black Jacks | 210:1 |
| 7. Suited & Same Rank Black Jacks | 500:1 |
| 8. Ace & Jack Suited Black Jacks | 1,000:1 |
| 9. Ace of Spades & Jack of Spades Black Jacks | 2,100:1 |

Based on this pay table, a player could determine the possible winning categories of black jacks and their payout ratios. For example, if the player placed only a wager on the player's hand (wager position 30*a–g*) and the player's hand was a suited black jack, the player would win 21 times the player's wager. If the player wagered only on the dealer's hand (wager position 28*a–g*) and the dealer's hand was a suited black jack, the player would receive 21 times the player's wager, but if the player wagering on both the dealer's and player's hand (wager position 30*a–g* and 28*a–g*) and bother were suited black jacks, the player would receive 210 times the player's wager. If the player wagered on both the player's and dealer's positions, and both the player's and dealer's hands were ace of spades and jack of spades black jacks (certain suit certain rank black jacks), the player would receive 2,100 times the player's wager. Betting on both the dealer's and player's hands is the preferred embodiment for multi-hand payouts. In the alternative embodiment, the player would receive the higher multi-hand payouts, if the player placed a wager on at least one of the positions. Bonuses may also be indicated on the pay table where the player would be paid a bonus if the player wagered on a category and a black jack in the category occurred.

Figure 2:
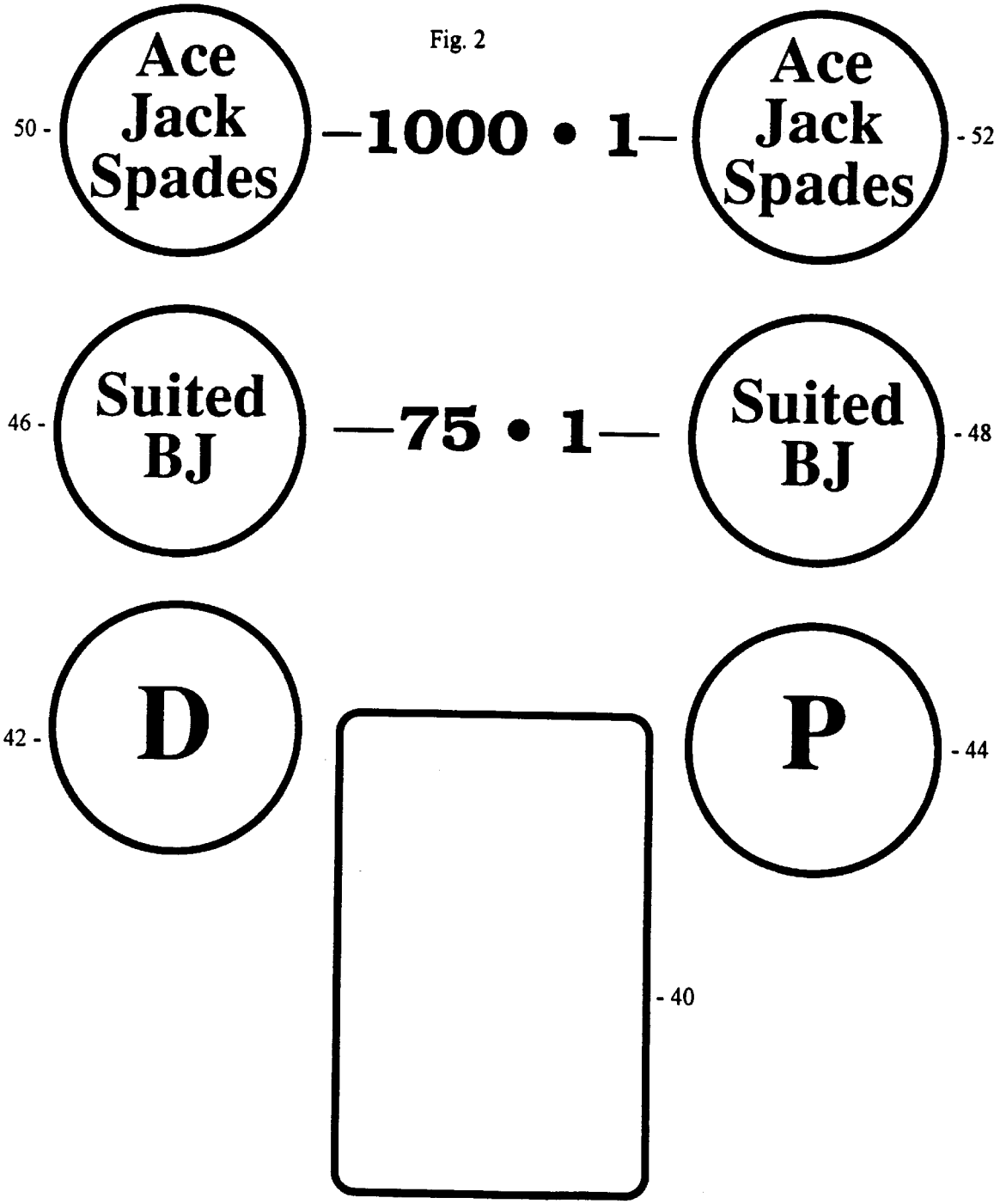
FIG. 2 is a top view of a possible player position to implement the game of the invention.

FIG. 2 represents a closeup of a player position which utilizes an alternative embodiment of the game of the present invention. In this embodiment, a player may make a combination wager as well as individual wagers. The player position may include card region 40 for receiving the player's cards. Dealer and player wager positions 42 and 44 may be combination wagers as in the first embodiment and may be defined by Table 1 or 2. However, wager positions 46 and 48 are for individual wagers in that they are defined to be a single category; suited black jacks. In this embodiment, the payout ratio is indicated between the wager positions and is defined to be 75 to one. If the player placed a wager on either wager position 46 or 48 and the respective hand was a suited black jack, the player would win 75 times his wager. If the player placed a wager on both wager positions 46 and 48 and both hands were suited black jacks, the player would receive 75 times his wagers for each respective hand. Wager positions 50 and 52 are defined to be ace of spades and jack of spades (certain suit certain rank black jack) and pays one thousand to one. Wagers placed on these positions pay in a manner similar to wagers placed on wager positions 46 and 48. In the preferred embodiment, the payout ratios are substantial proportional to the odds of occurrence of the given category. Thus categories which have a low probability of occurrence have greater payout ratios when compared with categories which have a higher probability of occurrence.

Figure 3:
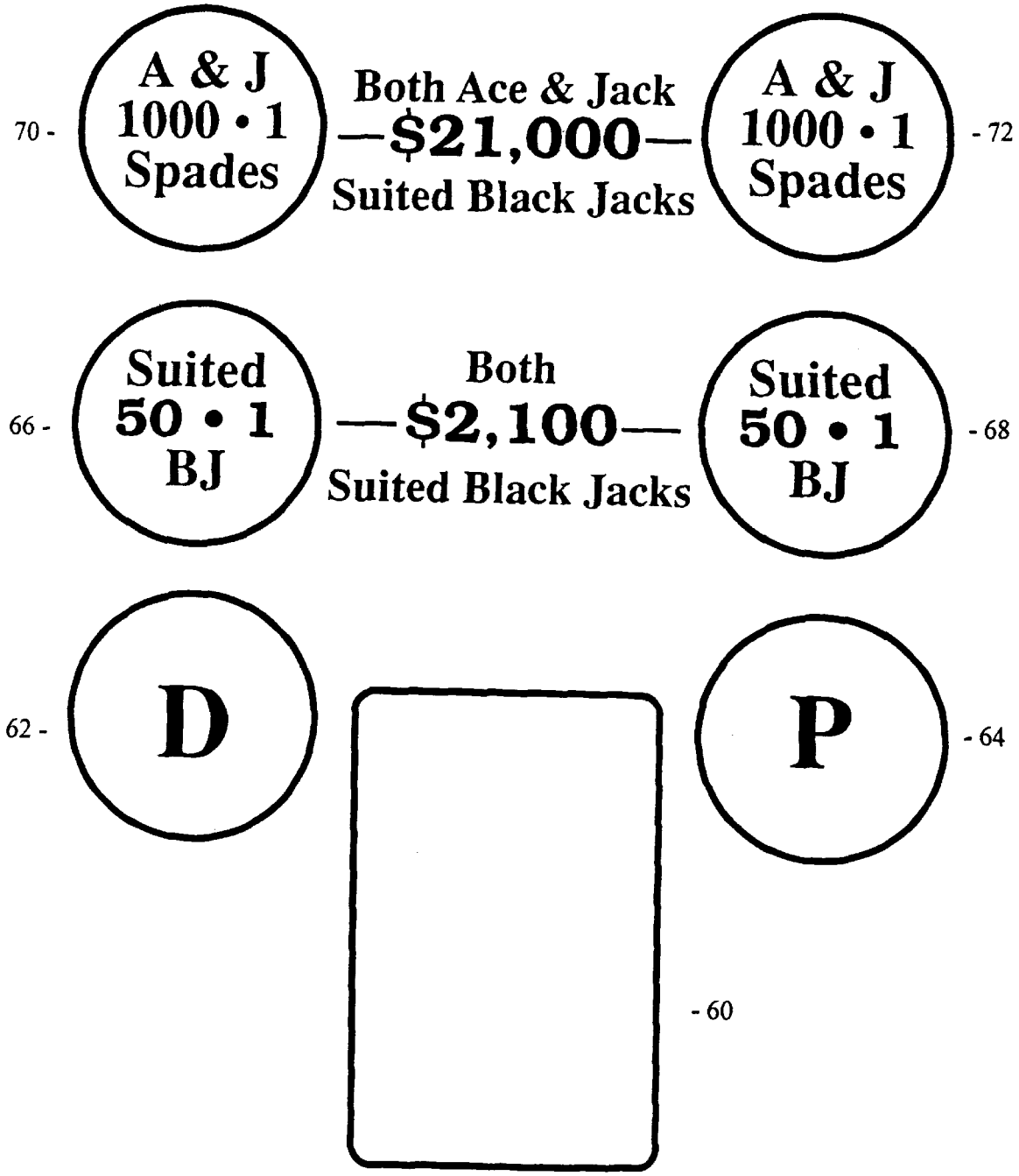
FIG. 3 is a top view of another possible player position to implement the game of the invention.

FIG. 3 represents another embodiment in which card region 60, dealer wager position 62, and player wager position 64 perform the same functions as in the embodiment in FIG. 2. However, the individual wagers in this embodiment pay a bonus if the stated condition occurs. For example if a player places a wager on both wager positions 66 and 68 and both the dealer's and player's hands are suited black jacks, the player will win fifty times his wager for each hand as well as a bonus of $2,100. In the preferred embodiment, if the player did not place a wager on both wager positions 66 and 68, he would not be paid the bonus. However, in the alternative embodiment, the player would receive the bonus if the player placed a wager on at least one of the positions. Wager positions 70 and 72 operate in a similar way as wager positions 66 and 68 except that the specified categories are ace of spades and jack of spades (certain suit certain rank black jack) and the bonus is paid under a different condition. The bonus associated with wager regions 70 and 72 is paid if both the dealer's and player's hands are ace and jack suited black jacks (suited certain rank black jack).

Figure 4:
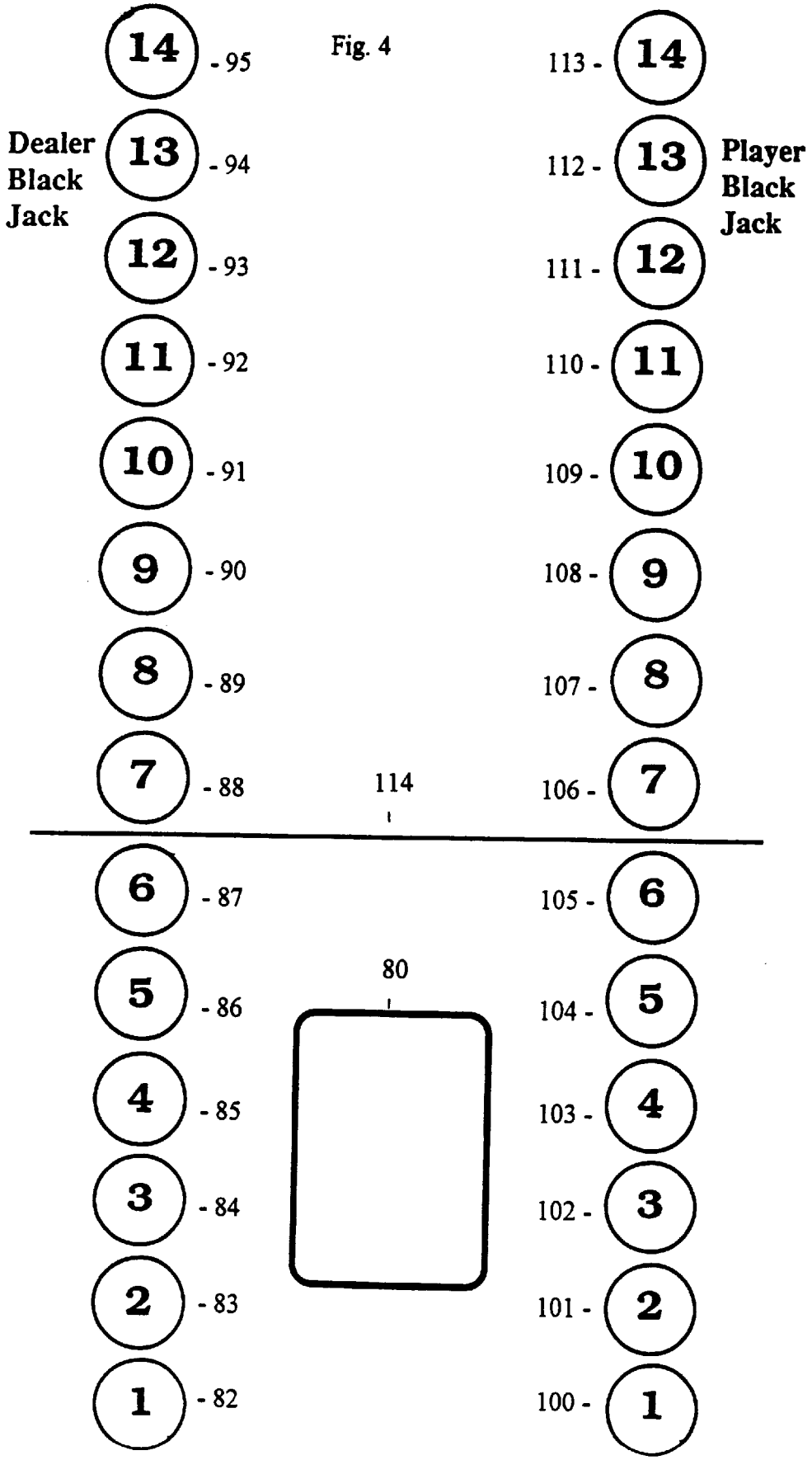
FIG. 4 is a top view of another possible player position to implement the game of the invention.

FIG. 4 represents another embodiment of the invention. This embodiment includes card region 80, dealer wager positions 82–95, and player wager positions 100–113. In this embodiment, the wager positions can be defined to be any black jack category or combination of categories. The definition of each position may be defined on the table next to the position or in a separate table. A line 114 may be used to indicate that wager positions below the line are single hand categories; either the dealer's, the player's, or another player's hand. Positions above line 114 may be the eight multi-hand categories. Because this embodiment utilizes numerous wager positions, many different categories can be wagered on by the player.

In another embodiment, multi-hand categories of black jacks may be applied to sequential player's or dealer's hands. In this embodiment, a player would wager on a multi-hand category. The player must then receive two consecutive hands which fall within this category in order to win his wager. For example, the player wagers on same rank black jacks. The first hand is dealt and the player receives an ace of hearts and a ten of clubs. Because the player received a black jack which may satisfy the category upon which the player wagered, the player's wager will continue to ride. The player is then dealt a second hand. If the second hand is a black jack with any ten card, the player has satisfied the multi-hand category, and will be paid a predetermined amount. If the player did not receive a same rank black jack, the player would lose. In an alternative embodiment, the player would have a specified number of hands in which to satisfy the multi-hand category. For example, two out of five player hands must fall within the selected category.

In yet another embodiment, a player's payout for any particular wager may be increased if the dealer's hand is an "up-card" of a certain rank. An "up-card" is a card the dealer deals to himself which is placed face up. For example, a player wagers on a suited black jack. The dealer then deals cards and deals a king up-card to himself. If king is the specified rank, the player's possible payout is increased a predetermined amount. If the player then receives a suited black jack, the player's payout will be higher then it would be without the dealer's king up-card.

What is claimed is:

1. A method of playing a black jack card game, comprising the following steps:

(A) providing at least one standard deck of playing cards divided into four suits, each suit having thirteen cards of two through ten, Jack, Queen, King and Ace, assigning each of the two through ten cards their numerical face value rank of two through ten, respectively, assigning each of the Jack, Queen and King cards a numerical value of rank of ten, and assigning each of the Ace cards a numerical value rank of one or eleven, (B) defining black jack as a hand having only two cards totaling exactly twenty-one, (C) a player placing a wager on the occurrence of a black jack within at least one specified category of black jacks, the specified category of black jacks being one of the following:

(1) rank black jacks, (2) suited black jacks, (3) certain suited black jacks, (4) suited rank black jacks, and (5) certain suited rank black jacks, (D) dealing cards whereby at least one hand having only two cards is formed, (E) examining the hand having only two cards to determine its content, and (F) the player winning a predetermined payout if the hand having only two cards contains a black jack within the category of black jacks.

2. The method of claim 1 wherein the player places a wager on the occurrence of a black jack within a plurality of categories of black jacks whereby the player wins a predetermined payout if the hand contains a black jack within at least one of the plurality of the categories of black jacks.

3. The method of claim 1 further comprising the step of the player winning a bonus if the hand contains a black jack within a predetermined category of black jacks.

4. The method of claim 1 wherein at least two hands of cards are formed, each hand having only two cards one of the hands having an up-card, the player having the other hand, the predetermined payout being increased if the up-card is a specified rank.

5. The method of claim 1 wherein at least two hands of cards are formed, each hand having only two cards and the specified category of black jacks include at least one of the following multi-hand categories:

(A) same rank black jacks, (B) certain rank black jacks, (C) suited black jacks, (D) certain suited black jacks, (E) suited same rank black jacks, (F) suited certain rank black jacks, and (G) certain suit certain rank black jacks, wherein the player wins a predetermined payout if both of the hands contain a black jack within the specified category of black jacks.

6. The method of claim 5 wherein one of the two hands is dealt to the player and one of the two hands is dealt to the dealer.

7. The method of claim 5 further comprising the step of the player winning a predetermined bonus if both of the two hands contain a black jack within a predetermined category of black jacks.

8. The method of claim 1 wherein the predetermined payout is substantially proportional to the odds of occurrence of a black jack within the category of black jacks.

9. A method of playing a black jack card game using a game table, said game table comprising at least one region for receiving wagers on at least one predetermined category of black jacks, the predetermined category of black jacks being one of the following categories:

(I) rank black jacks, (ii) suited black jacks, (iii) certain suited black jacks, (iv) suited rank black jacks, and (v) certain suited rank black jacks, the method comprising the following steps:

(A) providing at least one standard deck of playing cards divided into four suits, each suit having thirteen cards of two through ten, Jack, Queen, King and Ace, assigning each of the two through ten cards their numerical face value rank of two through ten, respectively, assigning each of the Jack, Queen and King cards a numerical value of rank of ten, and assigning each of the Ace cards a numerical value rank of one or eleven, (B) defining black jack as a hand having only two cards totaling exactly twenty-one, (C) a player placing a wager on the region, (D) dealing cards whereby at least one hand having only two cards is formed, (E) examining the hand having only two cards to determine its content, and (F)) the player winning a predetermined payout if the hand having only two cards contains a black jack within the predetermined category of black jacks.

10. The method of claim 9 wherein said region receives wagers on a plurality of categories of black jacks whereby the player wins a predetermined payout if the hand contains a black jack within at least one of the categories of black jacks.

11. The method of claim 9 further comprising the step of the player winning a bonus if the hand contains a black jack within a preselected category of black jacks.

12. The method of claim 9 wherein at least two hands of cards are formed, each hand having only two cards and the predetermined category of black jacks being at least one of the following multi-hand categories:

(A) same rank black jacks, (B) certain rank black jacks, (C) suited black jacks, (D) certain suited black jacks, (E) suited same rank black jacks, (F) suited certain rank black jacks, and (G) certain suit certain rank black jacks, wherein the player wins a predetermined payout if both of the two hands contain a black jack within the predetermined category of black jacks.

13. The method of claim 12 wherein one of the two hands is dealt to the player and one of the two hands is dealt to the dealer.

14. The method of claim 12 further comprising the step of the player winning a bonus if both of the two hands contain a black jack within a preselected category of black jacks.

15. The method of claim 9 wherein the predetermined payout is substantially proportional to the odds of occurrence of a black jack within the category of black jacks.

16. The method of claim 9 wherein at least two hands of cards are formed, one of the hands having an up-card, the player having the other hand, the predetermined payout being increased if the up-card is a specified rank.

17. A method of playing a black jack card game, comprising the following steps:

(A) providing at least one standard deck of playing cards divided into four suits, each suit having thirteen cards of two through ten, Jack, Queen, King and Ace, assigning each of the two through ten cards their numerical face value rank of two through ten, respectively, assigning each of the Jack, Queen and King cards a numerical value of rank of ten, and assigning each of the Ace cards a numerical value rank of one or eleven, (B) defining black jack as a hand having only two cards totaling exactly twenty-one, (C) a player placing a wager on the occurrence of at least one specified category of black jacks, (D) dealing cards to the player whereby a first hand having only two cards is formed for the player, (E) examining the first hand of cards to determine its content, (F) dealing cards to the player whereby a second hand having only two cards is formed for the player, (G) examining the second hand of cards to determine its content, and (H) the player winning a predetermined payout if the first and second hands of cards both contain a black jack within the category of black jacks.

18. The method of claim 17 wherein the category of black jacks include at least one of the following multi-hand categories:

(A) standard black jacks, (B) same rank black jacks, (C) certain rank black jacks, (D) suited black jacks, (E) certain suited black jacks, (F) suited same rank black jacks, (G) suited certain rank black jacks, and (H) certain suit certain rank black jacks.

* * * * *